United States Patent [19]

Pliefke

[11] Patent Number: 4,614,570

[45] Date of Patent: Sep. 30, 1986

[54] SINGLE-STAGE ELECTROCHEMICAL IMAGE-FORMING PROCESS FOR REPRODUCTION LAYERS

[75] Inventor: Engelbert Pliefke, Wiesbaden, Fed. Rep. of Germany

[73] Assignee: Hoechst Aktiengesellschaft, Frankfurt am Main, Fed. Rep. of Germany

[21] Appl. No.: 730,632

[22] Filed: May 6, 1985

[30] Foreign Application Priority Data

May 8, 1984 [DE] Fed. Rep. of Germany ..... 3416867

[51] Int. Cl.[4] ..... C25F 3/14

[52] U.S. Cl. ..... 204/129.65

[58] Field of Search ..... 204/129.65, 129.75

[56] References Cited

U.S. PATENT DOCUMENTS 4,086,853 5/1978 Figov et al. ..... 101/463

FOREIGN PATENT DOCUMENTS 0030642 6/1981 European Pat. Off. ..... 204/129.65

82/5879 6/1983 South Africa ..... 204/129.65

1490732 11/1977 United Kingdom ..... 204/129.65

*Primary Examiner*—T. M. Tufariello

*Attorney, Agent, or Firm*—Schwartz, Jeffery, Schwaab, Mack, Blumenthal & Evans

[57] ABSTRACT

In a novel process described for the image formation on reproduction layers which are optionally radiation-sensitive, an image is formed on a multi-layered material, which comprises at least one electrically conductive layer and a reproduction layer, by the action of electric current, applied via at least one electrode which can be stylus-shaped, in an aqueous electrolyte solution. Those portions of the layer which correspond to non-image areas are removed by the electrochemical treatment. An electrolyte solution is used, in particular, which has a pH in the range from 2.0 to 10.0 and which contains at least one salt in a concentration ranging from about 0.1 weight percent up to the saturation limit of the particular salt in the solution. The aqueous electrolyte solution may also contain a surfactant in a concentration range of about 0.1 weight percent to 5 weight percent.

14 Claims, No Drawings

SINGLE-STAGE ELECTROCHEMICAL IMAGE-FORMING PROCESS FOR REPRODUCTION LAYERS

BACKGROUND OF THE INVENTION

The present invention relates to a process for the single-stage imaging and developing or decoating of reproduction layers in an aqueous electrolyte solution.

Radiation-sensitive (photosensitive) reproduction layers are used, for example, in the preparation of offset printing plates and in the preparation of photoresists (both referred to hereinafter as copying materials). In general, such layers are applied to a support by the customer or industrial manufacturer. The layer supports used in such copying materials include metals, such as zinc, magnesium, chromium, copper, brass, steel, silicon, aluminum or combinations of these metals; plastic films; and paper or similar materials. These supports can be coated with the radiation-sensitive reproduction layer without a surface modifying pretreatment of the support, but preferably the coating step is preceded by surface modification such as mechanical, chemical and/or electrochemical roughening, surface oxidation and/or treatment with agents which impart hydrophilicity (for example in the case of supports for offset printing plates).

In addition to at least one radiation-sensitive compound, conventional reproduction layers also usually contain an organic binder (resins or the like) and, optionally, plasticizers, pigments, dyestuffs, surfactants, sensitizers, adhesion promoters, indicators and other customary additives. In order to produce an image from the reproduction layers, the layers are developed after their exposure (irradiation) to obtain, for example, a printing form or a photoresist. In the case of electrophotographic layers, the step of decoating corresponds to the developing step. Within the framework of this invention, the term "reproduction layers" also includes layers which do not contain a radiation-sensitive compound but which contain the other above-mentioned components, in particular an organic binder.

European Patent Application No. 0,073,445 (equivalent to South African Pat. No. 82/5879) discloses a process for developing irradiated reproduction layers, in which those parts of the layer which correspond to the non-image areas are removed with an aqueous electrolyte solution by an electrochemical treatment. The solution employed in particular has a pH in the range from 2.0 to 10.0 and contains at least one salt in a concentration from 0.1% up to the saturation limit of the solution of the particular salt. The electrolyte may furthermore contain a surfactant in a concentration of 0.1% to 5%. In this process, there is, however, required a separate irradiation step prior to development.

Processes have also been described by which it is possible to produce a printing form without an irradiation and/or developing step and thus without use of the customary reproduction layers containing a radiation-sensitive compound. Processes of this type are, for example, known from:

German Pat. No. 24 33 448 (corresponding to U.S. Pat. No. 4,086,853), which describes the use of an electro-responsive recording blank comprising (a) a hydrophobic underlayer (for example, comprised of polyester), (b) an electrically conductive hydrophilic layer (for example, comprised of aluminum) arranged thereon, which can be locally removed by the action of current applied via a stylus, and (c) a layer (for example, comprised of a cellulose derivative, a plasticizer and a pigment) which, as a result of the action of electric current, can be removed from layer (b);

German Offenlegungsschrift No. 25 14 682 (corresponding to British Pat. No. 1,490,732), which describes the use of an electro-responsive recording material comprising (a) an electrically conductive oleophilic layer (for example, comprised of aluminum) which cannot be removed by the action of electric current and (b) an oleophobic silicone rubber layer arranged thereon which can be locally removed by the action of current by means of a stylus;

European Patent Application No. 0,030,642, which describes a process for producing, by electro-erosion, a printing form from a sheet-like material which comprises (a) a hydrophobic substrate layer (for example, of polyester), (b) a hydrophilic, electrically conductive intermediate layer (for example, of aluminum) and (c) a protective dielectric top layer (for example, of $Al_2O_3$), in which process both layers (c) and (b) are removed by the action of electrodes.

It is true that printing forms can be produced using these processes, but it is impossible with such forms to achieve long print runs. Moreover, their practical use is considerably restricted by the materials comprising the hydrophilic and hydrophobic areas, or the oleophobic and oleophilic areas, of the printing form, respectively, e.g., with regard to the printing machines, chemicals, inks and/or paper that can be employed.

SUMMARY OF THE INVENTION

It is therefore an object of the present invention to provide an electrochemical process for producing an image on a sheet-like material, which process combines imaging and developing in a single stage.

It is another object of the present invention to provide a process by which digitalized information can be transferred directly onto material which subsequently serves as a printing form without first being irradiated.

In accomplishing the foregoing objects, there has been provided, in accordance with one aspect of the present invention, a process for electrochemically forming an image on a multi-layered, sheet-like material comprising at least one electrically conductive layer and a reproduction layer provided on the conductive layer, comprising the steps of:

(a) exposing at least a portion of the reproduction layer to an aqueous electrolyte solution capable of conducting an electrical current; and then, (b) between an electrode and the conductive layer, passing electrical current in a predetermined configuration through the aqueous electrolyte solution and the reproduction layer, respectively, in an amount sufficient to dissolve selected portions of the reproduction layer.

In one preferred embodiment, the above-mentioned reproduction layer comprises at least one radiation-sensitive compound, and is provided as a photoresist layer on a suitable support. In another preferred embodiment, the aforesaid sheet-like material is an offset printing plate.

Other objects, features, and advantages of the present invention will become apparent from the following detailed description. It should be understood, however, that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION OF THE PREFERRED EMBODIMENTS

In process of the present invention, those layer portions which correspond to non-image areas are removed by the above-mentioned electrochemical treatment. The aqueous electrolyte solution in general has a pH in the range from about 1 to 14, in particular from 2 to 10, and contains, in addition to the main constituent water, a dissociated compound, particularly at least one salt of an organic or inorganic acid in a concentration from 0.1 percent by weight up to the saturation limit of the solution of the particular salt. These salt solutions may also be present in the form of a buffer system and then also contain, in addition to the salt content, weak acids (such as acetic acid) or weak bases (such as ammonia). It may also be advantageous to shift the pH of the salt solutions by adding acids or bases, but the pH should not exceed nor be less than the values indicated above. Instead of the preferred salts, the aqueous electrolyte may also contain, as a dissociated compound, acids (such as acetic or boric acid) within the pH value range indicated.

Salts which can be used in the aqueous electrolyte in the process according to the invention include particularly those which contain, as cations, $Li^+$, $Na^+$, $K^+$, $NH_4^+$, $Al^{3+}$, $Fe^{2+}$, $Fe^{3+}$, $V^{5+}$, $Ca^{2+}$, $Mg^{2+}$, $Sr^{2+}$ and $Ba^{2+}$; and, as anions, $SO_4^{2-}$, $S_2O_3^{2-}$, $SCN^-$, $CO_3^{2-}$, $CH_3COO^-$, $NO_3^-$, $NO_2^{3-}$, $BO_2^-$, polyphosphates, polyborates, $F^-$, $Cl^-$, $Br^-$, $BF_4^-$, $N_3^-$, $VO_3^-$, anions of alkyl-sulfates (sulfuric acid monoalkyl ester anions) with 7 to 16 carbon atoms, and their corresponding hydrogen salts.

To promote uniformity and accelerate the process according to the present invention, the aqueous electrolyte may also contain a surfactant which is different from the dissociated compounds listed above, and which is preferably added in a concentration of 0.1 to 5 percent by weight. Not only non-ionic but also anionic or cationic surfactants can be used; however, they should preferably be of the low-foaming type, particularly when the process within the present invention is carried out in processing machines. Examples of surfactants which are suitable include alkali metal salts or ammonium salts of sulfuric acid monalkyl esters having $C_7$ to $C_{16}$ alkyl groups, ethoxylated alcohols and phenols, ethoxylated fatty amines and block polymers based on alkylene oxides (in particular those based on ethylene oxide and propylene oxide).

The process of the present invention makes possible the imagewise differentiation of the most diverse types of unirradiated reproduction layers in aqueous solutions which do not contain an organic solvent or other relatively large amounts of polluting additives. The degree of resolution obtainable in this process corresponds to that of conventional irradiation regimens and developers used in non-electrochemical processes.

Since the pH of a non-buffered aqueous electrolyte solution can change while the process according to the invention is being carried out, due to chemical or electrochemical changes in its components, the use of an additional buffer system is advisable when the aqueous electrolyte is to be used several times.

The concentration of the dissociated compound in the aqueous electrolyte may range from 0.1 percent by weight, in particular 1 percent by weight, to the particular saturation concentration of the dissociated compound. Concentrations of up to 5 percent by weight are generally sufficient. If the concentration of the aqueous electrolyte is below 0.1 percent by weight, the conductivity of the solution is usually too low, so that the resulting density becomes too low to achieve rapid development. The temperature of the aqueous electrolyte may range from room temperature up to the boiling point of the electrolyte system, a temperature of about 20° C. to 70° C. being preferably maintained. Agitation of the aqueous electrolyte during processing in accordance with the present invention is generally not necessary.

The process of the present invention is usually carried out using direct current alternating current of various frequencies and types of modulation, but it is also possible to use pulsed direct current. In the process, the current density can in principle also be outside a range of 1 to 100 $A/dm^2$, but this range is preferable, since otherwise the aqueous electrolyte is heated excessively, and the duration or quality of the image formation can be adversely affected. The current density increases at the start of the electrochemical imaging process, remains for a certain time at one level and increases again slightly towards the end of the developing process.

As a rule, hydrogen is evolved at the cathode during the electrochemical imaging process by discharge of $H^+(H_3O^+)$ ions. It is assumed that this strongly increases the local pH value and that, consequently, local dissolution of the image occurs. The high pH value which occasionally arises in this step can in some aqueous electrolyte systems lead to a local attack of the support of the reproduction layer; however, the actual image formation process is not affected thereby, and this attack can be reduced, should it be at all necessary, but the addition of corrosion inhibitors. Insufficient wetting of the reproduction layer by the aqueous electrolyte can occasionally lead to layer remainders in those areas which actually should be free from the layer (non-image areas), but this can be avoided by the use of a surfactant suitable for the layer concerned or by brief "soaking" of the plate in the aqueous electrolyte before the actual electrochemical image formation step.

The term "electrode, preferably in the shape of a stylus," refers to an oblong body which is made of a material that is as inert as possible (i.e., is not attacked during the process of the invention), such as stainless steel, graphite, gold or platinum, and which has a very small tip, in order to be able to achieve good resolution and very fine image dots or non-image dots, respectively. The electrode (or electrodes) is(are) guided over the sheet-like material which is to be provided with an image, at distances that are as small as possible (1–1,000 $\mu$m).

For the imaging of relatively large surfaces or for an acceleration of the process, it is also possible to use several stylus-type electrodes. Like a single electrode, these electrodes are controlled by a device wherein the image information is stored in a digitalized form. Suitable devices include, for example, "computer-to-plate" systems, i.e., systems, in which the image information is stored in a calculator and is transferred to the plate by direct triggering. The electrically conductive layer of the multi-like material and the stylus-type electrode(s), respectively, the aqueous electrolyte solution must be arranged such that it can cause an imagewise differentiation of the reproduction layer as a result of the interaction with the two elements serving as electrodes, which is achieved, for example, by immersing the two elements into the solution. In accordance with the process of the present invention, the term "reproduction layers" refers not only to the conventional, known radiation-sensitive layers (which are described below), but also to layers of similar composition which do not contain a radiation-sensitive compound; accordingly, the term "reproduction layers" as used herein includes all layers which, in accordance with the present invention, provide the capability of imagewise differentiation.

In a preferred embodiment of the present invention, the reproduction layer to be treated, which is present as part of the multi-layered sheet-like material having at least one electrically conductive layer, is contacted with the electrolyte solution by immersion. In this step, one edge of the sheet-like material should project beyond the surface of the electrolyte bath, so that a current supply can be connected to this portion. Another approach to supplying current is to establish the contact via the backside of the material, which is not provided with a reproduction layer. The electrode having the shape of a stylus should in particular be mounted at a uniform distance from the sheet-like material, so that a uniform current density can be achieved on each spot of the sheet-like material to be provided with an image.

The process of the present invention offers the advantage that, due to the dot-wise production of the non-image areas, the size of the latter can be controlled by varying the current density and time. The triggers can be generated, for example, directly by a computer-to-plate system. The uncoated backside of the sheet-like material to be treated should preferably be adjacent to a non-conductive material, in order to avoid unnecessary consumption of electric energy. Another possibility is to seal off the backside of the material, whereby the plate is guided in tight grooves in the electrolyte bath container. Furthermore, it is expedient to insulate all, but the tip of the stylus-type electrode(s).

The reproduction layer to be treated in particular is part (radiation-sensitive layer) of an offset printing plate or a resist (photoresist layer) applied to a support material. The reproduction layer generally contains a polymeric binder which is dissolved under the action of the electric current supplied by the electrode having the shape of a stylus, so that the portion of the sheet-like material lying underneath is bared. The present invention also includes layers which are based on polymeric binders, but do not contain a radiation-sensitive compound.

Suitable support materials are electrically conductive materials and include, for example, supports based on zinc, chromium, magnesium, copper, brass, steel, silicon, aluminum or combinations of the foregoing. These support materials may be provided with a suitable reproduction layer without any special modifying pretreatment, but preferably coating is carried out only after a surface modification treatment such as mechanical, chemical or electrochemical roughening, an oxidation and/or treatment with agents imparting hydrophilicity. Surface modifying pretreatment is particularly desirable for supports for offset printing plates.

Particularly suitable substrates for the preparation of offset printing plates include those made of aluminum or one of its alloys, which, for example, have an aluminum content of more than 98.0 percent by weight, and in particular of more than 98.5 percent by weight, and additionally contain Si, Fe, Ti, Cu, Zn, Mn and/or Mg.

Aluminum support materials for printing plates, which are very commonly used in practice, are generally roughened before application of the reproduction layer. Roughening may be effected mechanically (for example by, brushing and/or by treating with abrasive agents), chemically (for example, by means of etching agents) or electrochemically (for example, by treatment with alternating current in aqueous HCl or $HNO_3$ solutions). The mean peak-to-valley height ($R_z$) of the roughened surface is in the range from about 1 μm to 15 μm, in particular from 1.5 μm to 10 μm. The peak-to-valley height is determined according to DIN 4768, in the October 1970 version, i.e., $R_z$ is the arithmetic mean calculated from the individual peak-to-valley height values of five mutually adjacent individual measurement lengths.

Prior to roughening, the web of aluminum can be subjected to a precleaning treatment; this includes, for example, treatment with an aqueous NaOH solution with or without a degreasing agent and/or complex agents, trichloroethylene, acetone, methanol or other commercially available substances known as aluminum etching agents. Following roughening or, in the case of several roughening steps, between the individual steps, it is possible to perform an additional etching treatment, during which, in particular, a maximum amount of 2 $g/m^2$ is removed (between the individual steps, up to 5 $g/m^2$). Etching solutions in general are aqueous alkali metal hydroxide solutions or aqueous solutions or salts showing alkaline reactions, or are aqueous solutions of acids based on $HNO_3$, $H_2SO_4$, or $H_3PO_4$, respectively. Apart from an etching treatment step performed between the roughening step and an optional subsequent anodizing step, there are also known nonelectrochemical treatments which have a primarily rinsing and/or cleaning effect and are, for example, employed to remove deposits which have formed during roughening ("smut"), or simply to remove electrolyte remainders; dilute aqueous alkali metal hydroxide solutions or water can, for example, be used for these treatments.

The electrochemical roughening according to the invention is optionally followed, in a further process step, by an anodic oxidation of the aluminum to improve, for example, the abrasion and adhesion properties of the surface of the support material. Conventional electrolytes, such as $H_2SO_4$, $H_3PO_4$, $H_2C_2O_4$, amidosulfonic acid, sulfosuccinic acid, sulfosalicylic acid and mixtures thereof, may be used for the anodic oxidation. For this purpose, particular preference is given to $H_2SO_4$ and $H_3PO_4$, which may be used alone or in a mixture and/or in a multi-stage anodizing process. The weights of the aluminum oxide layers vary from about 1 $g/m^2$ to 10 $g/m^2$, which corresponds to layer thicknesses between about 0.3 μm and 3.0 μm.

The step of performing an anodic oxidation of the aluminum support material is optionally followed by one or more post-treating steps. Post-treating is particularly understood to be a hydrophilizing chemical or electrochemical treatment of the aluminum oxide layer. Examples of such post-treating steps include an immersion treatment of the material in an aqueous solution of polyvinyl phosphonic acid according to German Pat. No. 16 21 478 (corresponding to British Pat. No. 1,230,447); an immersion treatment in an aqueous solution of an alkali-metal silicate according to German Auslegeschrift No. 14 71 707 (corresponding to U.S. Pat. No. 3,181,461); and an electrochemical treatment (anodic oxidation) in an aqueous solution of an alkali metal silicate according to German Offenlegungsschrift No. 25 32 769 (corresponding to U.S. Pat. No. 3,902,796). These post-treatment steps serve, in particular, to improve even further the hydrophilic properties of the aluminum oxide layer, which are already sufficient for many fields of application, with the other well-known properties of the layer being at least maintained.

Suitable radiation-sensitive (photosensitive) layers include all layers which, after radiation (exposure), and, optionally, development and/or fixing, yield an image-wise-configured surface which can be used for printing, in accordance with conventional methods. As noted above, however, the reproduction layer of the present invention may not be photosensitive, so that the aforesaid conventional methods are not required by the present invention.

Apart from the silver halide-containing layers used for many applications, various other suitable photosensitve layers are known. They are described, for example, by Jaromir Kosar in *Light-Sensitive Systems*, published by John Wiley & Sons, New York, 1965, and include: colloid layers containing chromates and dichromates (Kosar, Chapter 2); layers containing unsaturated compounds, in which, upon exposure, these compounds are isomerized, rearranged, cyclized, or cross-linked (Kosar, Chapter 4); layers containing compounds which can be photopolymerized, in which, on being exposed, monomers or prepolymers undergo polymerization, optionally with the aid of an initiator (Kosar, Chapter 5); and layers containing o-diazoquinones, such as naphthoquinone-diazides, p-diazoquinones, or condensation products of diazonium salts (Kosar, Chapter 7).

Suitable layers also include electrophotographic layers, i.e., layers which contain an inorganic or organic photoconductor. In addition to the photosensitive substances, these layers can also contain other constituents, such as resins, dyes and plasticizers. In particular, the following radiation-sensitive compositions or compounds can be employed in the reproduction layers:

positive-working reproduction layers that contain o-quinone diazides, preferably o-naphthoquinone-(1,2)-diazide-(2)-sulfonic acid esters or amides as the light-sensitive compounds which are described, for example, in German Patentschriften No. 854,890, No. 865,109, No. 879,203, No. 894,959, No. 938,233, No. 1,109,521, No. 1,144,705, No. 1,118,606, No. 1,120,273, No. 1,124,817 and No. 2,331,377; and in European Patent Applications No. 0,021,428 and No. 0,055,814;

negative-working reproduction layers that contain condensation products from aromatic diazonium salts and compounds which active carbonyl groups, preferably condensation products formed from diphenylaminediazonium salts and formaldehyde, which are described, for example, in German Patentschriften No. 596,731, No. 1,138,399, No. 1,138,400, No. 1,138,401, No. 1,142,871 and No. 1,154,123; in U.S. Pat. No. 2,679,498 and No. 3,050,502; and in British Pat. No. 712,606;

negative-working reproduction layers that contain co-condensation products of aromatic diazonium compounds, such as are described, for example, in German Patentschrift No. 2,065,732, the disclosed products having at least one unit each of (a) an aromatic diazonium salt compound able to participate in a condensation reaction and (b) a compound able to participate in a condensation reaction, such as a phenol ether or an aromatic thioether, that are connected by a bivalent linking member derived from a carbonyl compound which is capable of participating in a condensation reaction, such as a methylene group;

positive-working layers according to German Offenlegungschriften No. 2,610,842 and No. 2,928,636, and German Patentschrift No. 2,718,254, that contain (a) a compound which, on being irradiated, splits off an acid, (b) a monomeric or polymeric compound which possesses at least one C—O—C group which can be split off by acid (e.g., an orthocarboxylic acid ester group or a carboxylic acid amide acetal group), and, if appropriate, (c) a binder;

negative-working layers comprised of photopolymerizable monomers, photo-initiators, binders and, if appropriate, further additives (in these layers, for example, acrylic and methacrylic acid esters, or reaction products of diisocyanates with partial ester of polyhydric alcohols are employed as monomers, as described, for example, in U.S. Pat. No. 2,760,863 and No. 3,060,023, and in German Offenlegungsschriften No. 2,064,079 and No. 2,361,041); and negative-working layers according to German Offenlegungsschrift No. 3,036,077, which contain, as the photosensitive compound, a diazonium salt polycondensation product or an organic azido compound, and, as the binder, a high-molecular weight polymer with alkenylsulfonylurethane or cycloalkenylsulfonylurethane side groups.

It is also possible to apply photosemiconducting layers, such as are described in German Patentschriften No. 1,117,391, No. 1,522,497, No. 1,572,312, No. 2,322,046 and No. 2,322,047.

If the above-described layers, which contain at least one radiation-sensitive compound, also include at least one binder, they can also be employed without the radiation-sensitive compound in the process of the present invention. The following organic polymers, which are soluble in the aqueous electrolyte solution, are then particularly suitable: polyamides, polyesters, alkyd resins, polyvinyl alcohol, polyvinyl pyrrolidone, polyethylene oxide, polyacetals, gelatin and/or cellulose ethers.

The reproduction layer in general has a thickness of between about 0.1 μm and about 1 mm or more.

In those cases where the radiation-sensitive compounds contained in the reproduction layer are compounds which yield a negative-working system, it is expedient to subject the whole surface of the sheet-like material to a post-exposure or post-heating treatment performed on that side of the material which carries the reproduction layer. Positive-working systems do not require a special post-exposure. Of the radiation-sensitive reproduction layers, the positive-working layers are preferred in the process of the present invention. In order to achieve a further increase in the print run, "baking", i.e., a thermal or comparable post-treatment of the sheet-like material, can be performed after an image has been formed in accordance with the present invention, whereby the mechanical and/or chemical stability of the image areas is increased.

With the process of the present invention, it is thus possible to combine the imaging and developing steps for a reproduction layer, which steps are customarily performed in two stages, in a single stage.

In the above description and in the examples which follow, percentages relate to weight, unless otherwise stated. Parts by weight (p.b.w.) are related to parts by volume as the gram is related to $cm^3$. The reproduction layers to be treated are provided on conductive supports and are connected as the cathode in a direct current circuit, unless otherwise indicated, and the electrodes preferably having the shape of a stylus are the anodes. The temperature of the electrolyte is about 25° C. to 30° C., unless otherwise indicated, and the distance of the material to be treated from the counter-electrode is as small as possible, without a short-circuit occurring. As a rule, the course of the current density can be described as follows: the current density first increases for a few μsec to a certain value, remains for a few μsec at this level and can then again increase slightly towards the end of the electrolytic treatment. Unless indicated otherwise, the treated materials conform to customary standards.

EXAMPLE 1

The following positive-working light-sensitive solution was applied to an electrochemically roughened and anodically oxidized aluminum foil by flow-coating:

- 6.6: p.b.w. of a cresol-formaldehyde novolak (with a softening range of 105°–120° C., according to DIN 53,181);
- 1.1: p.b.w. of the 4-(2-phenylprop-2-yl)-phenyl ester of 1,2-naphthoquinone-2-diazide-4-sulfonic acid;
- 0.6: p.b.w. of 2,2'-bis-[1,2-naphthoquinone-2-diazide-5-sulfonyloxyl]-1,1'-dinaphthylmethane;
- 0.24: p.b.w. of 1,2-naphthoquinone-2-diazide-4-sulfochloride;
- 0.08: p.b.w. of crystal violet;
- 91.36: p.b.w. of a mixture of 4 p.b.v. of ethylene glycol monomethyl ether, 5 p.b.v. of tetrahydrofuran and 1 p.b.v. of butyl acetate.

After drying, the resulting plate was provided with an image in an aqueous solution containing 3 percent of lithium sulfate and 1 percent of sodium octyl sulfate (sodium salt of the sulfuric acid monooctyl ester) at a pH of 3.5, by means of a stylus-type electrode and a voltage that was varied as a function of dot size in the non-image areas.

EXAMPLE 2

Aluminum foil, mechanically roughened with steel brushes, was coated with the following solution and then dried in a drying duct at temperatures up to 100° C.:

- 1.15: p.b.w of the esterification product of 1 mole of 2,3,4-trihydroxybenzophenone and 2 moles of 1,2-naphthoquinone-2-diazide-5-sulfonic acid chloride;
- 7.15: p.b.w. of a phenol-formaldehyde novolak (having 14 percent of phenolic OH groups and a softening range of 110°–120° C., according to DIN 53,181);
- 0.64: p.b.w. of 2,2'-bis-[1,2-naphthoquinone-2-diazide-5-sulfonyloxy]-1,1'-dinaphthyl methane;
- 0.15: p.b.w. of crystal violet;
- 0.08: p.b.w. of Sudan Yellow GGN (C.I. 11,021); and
- 92.25: p.b.w. of a mixture of 40 p.b.v of ethylene glycol monomethyl ether and 50 p.b.v. of tetrahydrofuran.

By means of a stylus-type electrode, the resulting plate was electrochemically provided with an image in an aqueous solution containing 3 percent of lithium sulfate and 1 percent of sodium octyl sulfate, at a pH of 7.5 and a voltage of about 60 V, depending on the particular dot size.

EXAMPLE 3

A negative-working light-sensitive solution comprised of:

- 14: p.b.w. of a copolymer of methyl methacrylate and methacrylic acid, having a mean molecular weight of 40,000 and an acid number of 90 to 115;
- 14: p.b.w. of 1,1,1-trimethylol-ethanetriacrylate;
- 2: p.b.w. of 1,6-dihydroxy-ethoxy-hexane;
- 0.50: p.b.w. of 9-p-hydroxyphenylacridine; and
- 130: p.b.w. of ethylene glycol monoethyl ether was applied to an electrochemically roughened and anodically oxidized aluminum foil rendered hydrophilic with an aqueous solution of polyvinylphosphonic acid. After drying, the plate was electrochemically provided with an image in an aqueous solution containing 3 percent of lithium sulfate and 1 percent of sodium octyl sulfate, at a pH of 3.5, by means of a stylus-type electrode and a voltage of about 10 V, depending on dot size. Then the plate was dried for 5 minutes at 220° C.

EXAMPLE 4

A layer of the following negative-working, light-sensitive mixture was applied to an electrochemically roughened and anodically oxidized aluminum foil which had been rendered hydrophilic by treatment with an aqueous solution of polyvinylphosphonic acid:

- 26.75: p.b.w. of an 8 percent solution of the reaction product of a polyvinylbutyral (having a molecular weight of 70,000 to 80,000 and comprising 71 percent of vinylbutyral units, 2 percent of vinyl acetate units and 27 percent of vinyl alcohol units) with propenylsulfonyl isocyanate;
- 2.14: p.b.w. of 2,6-bis-(4-azidobenzene)-4-methylcyclohexanone;
- 0.23: p.b.w. of Rhodamin 6 GDN extra;
- 0.21: p.b.w. of 2-benzoylmethylene-1-methyl-β-naphthothiazoline;
- 100: p.b.v. of ethylene glycol monomethyl ether; and
- 50: p.b.v. of tetrahydrofuran.

Electrochemical dot-wise imaging was effected in an aqueous solution containing 1.5 percent of lithium carbonate and 1 percent of sodium octyl-sulfate at a pH of 8 and about 60 V. After being wiped clean and dried at 220° C., a printing plate adequate for practical used was obtained.

EXAMPLE 5

An electrophotographic layer comprising:

- 10: p.b.w. of 2-vinyl-5-(4'-diethylaminophenyl)-4-(2'-chlorophenyl)-oxazole;
- 10: p.b.w. of a copolymer of styrene and maleic acid anhydride (having a softening point of 210° C.);
- 0.02: p.b.w. of Rhodamin FB (C.I. 45,170); and
- 300: p.b.w. of ethylene glycol monomethyl ether was applied to an electrochemically roughened and anodically oxidized aluminum foil which had been rendered hydrophilic by treatment with an aqueous solution of polyvinylphosphonic acid. The dried plate could then be electrochemically decoated in imagewise, screened configuration, in a 1.5 percent aqueous lithium carbonate solution containing 1 percent of sodium octylsulfate, using the stylus-type electrode, for 8 to 12 seconds at 60 V (pH 8 and 50° C.), after a preceding nonelectrolytic residence time in the solution of 30 seconds.

EXAMPLE 6

The electrophotographic layer of Example 5 was applied to an aluminum support, mechanically roughened by dry brushing, and processed according to the procedure of Example 5. The imagewise decoating was carried out in the same electrolyte under identical conditions, but without a preceding non-electrochemical treatment step.

EXAMPLE 7

An electrochemically roughened and anodically oxidized aluminum support, which had been rendered hydrophilic by treatment with an aqueous solution of polyvinylphosphonic acid, was coated with the following negative-working, light-sensitive solution:

1: p.b.w. of the polycondensation product of 1 mole of 3-methoxydiphenylamine-4-diazonium sulfate and 1 mole of 4,4'-bis-methoxymethyl-diphenyl ether, precipitated as the salt of mesitylenesulfonic acid;

1.8: p.b.w. of non-plasticized urea resin (having a viscosity in 65 percent strength solution in butanol/xylene, at 20° C., of about 6,000 mPa.s and an acid number below 3);

0.4: p.b.w. of crystal violet; and

98: p.b.w. of ethylene glycol monomethyl ether.

Electrochemical imagewise treatment was effected in an aqueous solution containing 3 percent of sodium phosphate and 3 percent of an ethoxylated isotridecyl alcohol containing 8 ethylene oxide units at a pH of 7 (pH value set with $H_3PO_4$) and about 20 V, depending on the dot size. After imaging, the plate was dried at 220° C. or hardened by post-exposure. The plate prepared in this way had a print run of about 80,000 copies.

EXAMPLE 8

A positive-working light-sensitive solution comprising:

25: p.b.w. of bis-(5-ethyl-5-butyl-1,3-dioxan-2-yl) ether of 2-ethyl-2-butyl-1,3-paropanediol;

71: p.b.w. of a cresol-formaldehyde novolak;

0.7: p.b.w. of crystal violet base;

3: p.b.w. of 2-(acenaphth-5-yl)-4,6-bis-trichloromethyl-s-triazine; and

900: p.b.w. of ethylene glycol monomethyl ether was applied to an electrochemically roughened and anodically oxidized aluminum foil. After the foil was dried, a potential of about 15 to 20 V was used to provide the foil electrochemically with an image in an aqueous solution containing 3 percent of lithium sulfate and 1 percent of sodium octylsulfate at a pH of 3.5.

EXAMPLE 9

The plate of Example 3 was electrochemically treated in a 6 percent aqueous sodium lauryl-sulfate solution at a pH of 4.

EXAMPLE 10

An aluminum foil, mechanically roughened by dry brushing and anodically oxidized, was coated with a positive-working, light-sensitive solution comprising:

1.6: p.b.w. of the esterification product of 1 mole of 2,3,4-trihydroxybenzophenone and 2 moles of 1,2-naphthoquinone-2-diazide-5-sulfonic acid chloride;

0.9: p.b.w. of 2,2'-bis-[1,2-naphthoquinone-2-diazide-5-sulfonyloxy]-1,1'-dinaphthylmethane;

6.4: p.b.w. of a cresol-formaldehyde novolak (having a softening range of 105°-120° C., according to DIN 53,181);

90.1: p.b.w. of a mixture of 4 p.b.v. of ethylene glycol monomethyl ether, 5 p.b.v. of tetrahydrofuran and 1 p.b.v. of butyl acetate.

The coated foil was electrochemically treated in an aqueous solution containing 3 percent of ammonium phosphate and 1 percent of sodium octyl-sulfate, at a pH of 7.5 (set with $H_3PO_4$).

EXAMPLE 11

The following solution, which did not contain a radiation-sensitive compound, was applied to an electrochemically roughened and anodically oxidized aluminum foil by flow-coating using a slot die:

6.6: p.b.w. of a cresol-formaldehyde novolak (with a softening range of 105°-120° C., according to DIN 53,181);

0.08: p.b.w. of crystal violet; and 91.36: p.b.w. of a mixture of 4 p.b.v. of ethylene glycol monomethyl ether, 5 p.b.v. of tetrahydrofuran and 1 p.b.v. of butyl acetate.

A stylus-type electrode and a voltage that was varied as a function of the dot size was used to provide the resulting plate, after drying, with an image in an aqueous solution containing 3 percent of lithium sulfate and 1 percent of sodium octyl sulfate (sodium salt of the sulfuric acid monooctyl ester) at a pH of 3.5.

EXAMPLE 12

An aluminum foil, mechanically roughened with steel brushes, was coated with the following solution, which did not contain a radiation-sensitive compound, and then was dried in a drying duct at temperatures up to 100° C.:

7.15: p.b.w. of a phenol-formaldehyde novolak (having 14 percent of phenolic OH groups and a softening range of 110°-120° C., according to DIN 53,181);

0.15: p.b.w. of crystal violet;

0.08: p.b.w. of Sudan Yellow GGN (C.I. 11,021); and 92.25: p.b.w. of a mixture of 40 p.b.v. of ethylene glycol monomethyl ether and 50 p.b.v. of tetrahydrofuran.

By means of a stylus-type electrode, the resulting plate was electrochemically provided with an image in an aqueous solution containing 3 percent of lithium sulfate and 1 percent of sodium octyl sulfate, at a pH of 7.5 and a voltage of about 60 V, depending on the respective dot size.

EXAMPLE 13

A non-electrophotographic layer comprising:

10: p.b.w. of a copolymer of styrene and maleic acid anhydride (having a softening point of 210° C.); and 300: p.b.w. of ethylene glycol monomethyl ether was applied to an electrochemically roughened and anodically oxidized aluminum foil which had been rendered hydrophilic with an aqueous solution of polyvinylphosphonic acid. With the stylus-type electrode, the dried plate could then be electrochemically decoated in imagewise, screened configuration, in a 1.5 percent aqueous lithium carbonate solution containing 1 percent of sodium octyl-sulfate for 8 to 12 seconds at 60 V (pH 8 and 50° C.) after a preceding non-electrolytic residence time in the solution of 30 seconds.

EXAMPLE 14

The layer of Example 13 was applied to an aluminum support, mechanically roughened by dry brushing, and processed according to the procedure of Example 13. The imagewise decoating was carried out in the same electrolyte under identical conditions, but without a preceding non-electrochemical treatment phase.

EXAMPLE 15 TO 65

Certain of the copying materials described above were electrochemically treated in imagewise configuration in a solution indicated in the following table. The conditions are also given in the table.

TABLE I

| Example | Type of material | aqueous electrolyte Type | aqueous electrolyte Concentr. (%) | Surfactant Type | Surfactant Concentr. (%) | pH Value | Remarks (T = Temperature) |
|---|---|---|---|---|---|---|---|
| 15 | radiation-sensitive layer according to Example 1 support additionally rendered hydrophilic with an aqueous solution of polyvinylphosphonic acid | Na thiosulfate | 3 | Na octylsulfate | 1 | 3.5 | — |
| 16 | see Example 6 | Na sulfate | 3 | Na octylsulfate | 1 | 2.5 | T 40° C. |
| 17 | see Example 5 | $Na_4$ phosphate | 3 | ethoxylated isotridecyl alcohol containing 8 ethylene oxide units | 3 | 8 | T 45° C. |
| 18 | see Example 3 | Li sulfate | 3 | stearylammonium chloride/ethylene oxide adduct containing 5 ethylene oxide units | 0.6 | 4 | — |
| 19 | see Example 2 | Al sulfate | 3 | Na octylsulfate | 1 | 8 | — |
| 20 | see Example 1 | Na sulfate | 3 | Na octylsulfate | 1 | 2.5 | — |
| 21 | see Example 3 | " | 3 | Na octylsulfate | 1 | 2.5 | — |
| 22 | see Example 6 | Na phosphate | 3 | — | — | 3–4 | T 45 to 55° C., pH set with $H_3PO_4$ |
| 23 | see Example 2 | Na nitrate | 3 | Na octylsulfate | 1 | 3 | — |
| 24 | see Example 15 | " | 3 | Na octylsulfate | 1 | 2.5 | — |
| 25 | see Example 3 | Na bromide | 3 | Na-octylsulfate | 1 | 6 | — |
| 26 | see Example 2 | Na phosphate | 3 | — | — | 7 | pH set with $H_3PO_4$ |
| 27 | radiation-sensitive layer according to Example 1, support of chromed iron | Na hydrogencarbonate | 3 | ethoxylated isotridecyl alcohol containing 8 ethylene oxide units | 3 | 4 | — |
| 28 | see Example 3 | Na nitrate | 3 | Na octylsulfate | 1 | 3 | — |
| 29 | see Example 2 | Na bromide | 3 | Na octylsulfate | 1 | 3 | — |
| 30 | see Example 27 | Na phosphate | 3 | ethoxylated isotridecyl alcohol containing 8 ethylene oxide units | 3 | 8 | — |
| 31 | see Example 3 | Li sulfate | 3 | Na salt of the sulfuric acid mono(7-ethyl-2-methylundec-4-yl)ester | 1 | 4 | — |
| 32 | see Example 2 | Na chloride | 3 | Na octylsulfate | 1 | 6 | — |
| 33 | see Example 15 | Li sulfate | 3 | Na octylsulfate | 1 | 3.5 | — |
| 34 | see Example 3 | Na chloride | 3 | Na octylsulfate | 1 | 6 | — |
| 35 | see Example 2 | Na vanadate | 3 | Na octylsulfate | 1 | 9.5 | — |
| 36 | see Example 15 | Li sulfate | 3 | Na Salt of the sulfuric acid mono(7-ethyl-2-methylundec-4-yl)ester | 1 | 4 | — |
| 37 | see Example 5 | Na chloride | 3 | Na octylsulfate | 1 | 4 | oxide layer slightly |

TABLE I-continued

| Example | Type of material | aqueous electrolyte Type | aqueous electrolyte Concentr. (%) | Surfactant Type | Surfactant Concentr. (%) | pH Value | Remarks (T = Temperature) |
|---|---|---|---|---|---|---|---|
| | | | | | | | attacked |
| 38 | see Example 2 | Na lauryl-sulfate | 6 | — | — | 4 | — |
| 39 | see Example 15 | Na nitrate | 3 | Na octylsulfate | 1 | 4 | — |
| 40 | see Example 3 | Na nitrate | 3 | ethoxylated isotridecyl alcohol containing 8 ethylene oxide units | 3 | 4 | — |
| 41 | see Example 2 | Li sulfate | 3 | stearylammonium chloride/ethylene oxid adduct containing 5 ethylene oxide units | 0.6 | 7 | — |
| 42 | see Example 2 | $NH_4$ phosphate | 3 | Na decylsulfate | 1 | 9 | — |
| 43 | see Example 27 | Na nitrate | 3 | ethoxylated isotridecyl alcohol containing 8 ethylene oxide units | 3 | 4 | — |
| 44 | see Example 3 | Na phosphate | 3 | ethoxylated isotridecyl alcohol containing 8 ethylene oxide units | 3 | 7–8 | pH set with $H_3PO_4$ |
| 45 | see Example 2 | Na phosphate | 3 | Na octylsulfate | 1 | 7 | pH set with $H_3PO_4$ |
| 46 | see Example 3 | $NH_4$ sulfate | 3 | Na octylsulfate | 1 | 3 | — |
| 47 | see Example 2 | Mg sulfate | 3 | " | 1 | 6 | — |
| 48 | see Example 2 | " | 3 | " | 1 | 2.5 | pH set with $H_3PO_4$ |
| 49 | see Example 2 | Na hydrogen carbonate | 3 | ethoxylated isotridecyl alcohol containing 8 ethylene oxide units | 3 | 8 | — |
| 50 | see Example 2 | Na acetate | 3 | ethoxylated isotridecyl alcohol containing 8 ethylene oxide units | 3 | 4.5 | — |
| 51 | see Example 1 | Li sulfate | 3 | stearylammonium chloride/ethylene oxide adduct containing 5 ethylene oxide units | 0.6 | 5 | — |
| 52 | see Example 2 | Na hydrogen carbonate | 3 | ethoxylated isotridecyl alcohol containing 8 ethylene oxide units | 3 | 4 | — |
| 53 | radiation-sensitive layer according to Example 1, support mechanically roughened with brushes and abradants | Na chloride | 3 | ethoxylated isotridecyl alcohol containing 8 ethylene oxide units | 3 | 6 | — |
| 54 | see Example 2 | Na borate | 3 | ethoxylated isotridecyl alcohol containing 8 ethylene oxide units | 3 | 3.5 | — |
| 55 | see Example 53 | Na nitrate | 3 | ethoxylated isotridecyl alcohol containing 8 ethylene oxide units | 3 | 4 | — |
| 56 | see Example 2 | Na phosphate | 3 | ethoxylated isotridecyl alcohol containing 8 ethylene oxide units | 3 | 7 | pH set with $H_3PO_4$, alternating current 40 V/50 Hz |
| 57 | see Example 2 | Li sulfate | 3 | Na octylsulfate | 1 | 3 | alternating current 40 V, 50 Hz |
| 58 | see Example 3 | " | 3 | " | 1 | 3 | alternating current |

TABLE I-continued

| Example | Type of material | aqueous electrolyte Type | aqueous electrolyte Concentr. (%) | Surfactant Type | Surfactant Concentr. (%) | pH Value | Remarks (T = Temperature) |
|---|---|---|---|---|---|---|---|
| 59 | see Example 2 | " | 3 | " | 1 | 3 | 40 V, 50 Hz alternating current 0.5 Hz |
| 60 | see Example 2 | " | 3 | " | 1 | 3 | alternating current 5 Hz |
| 61 | see Example 2 | " | 3 | " | 1 | 3 | alternating current 500 Hz |
| 62 | see Example 2 | $NH_4$ phosphate | 3 | " | 1 | 7.5 | — |
| 63 | see Example 3 | tetraethyl-ammonium-hydroxide | 3 | ethoxylated isotridecyl alcohol containing 8 ethylene oxide units | 3 | 3 | pH set with $H_3PO_4$ |
| 64 | see Example 3 | boric acid | 3 | Na octylsulfate | 1 | 2.5 | T 50° C. |
| 65 | see Example 3 | acetic acid | 3 | " | 1 | 2.5 | T 50° C. |

EXAMPLE 66

An electrochemically roughened and anodically oxidized aluminum foil which had been rendered hydrophilic by treatment with an aqueous solution of polyvinylphosphonic acid was coated with the following negative-working, light-sensitive solution:

2: p.b.w. of a styrene/maleic acid anhydride copolymer (1:1, molecular weight 50,000) which had been reacted with hydroxyethyl methacrylate;
2: p.b.w. of a diurethane produced by reacting 2 moles of glycerol dimethylacrylate and 1 mole of hexamethylene diisocyanate;
0.70: p.b.w. of 9-phenylacridine;
0.07: p.b.w. of Samaron Navy;
32: p.b.w. of butanone;
12: p.b.w. of butyl acetate; and
12: p.b.w. of ethylene glycol monomethyl ether.

After drying, the electrochemical treatment was effected in an aqueous solution containing 3 percent of ammonium sulfate and 1 percent of sodium octylsulfate at a pH of 4 and a potential of about 40 V.

EXAMPLE 67

The plate of Example 66 was electrochemically treated in an aqueous solution (pH 4) containing 3 percent of sodium nitrate and 3 percent of an ethoxylated isotridecyl alcohol having 8 ethylene oxide units.

EXAMPLE 68

An electrochemically roughened and anodically oxidized aluminum foil was coated with an electrophotographic solution comprising:

10: p.b.w. of 2,5-bis-(4'-diethylaminophenyl)-1,3,4-oxadiazole;
10: p.b.w. of a copolymer of styrene and maleic acid anhydride (having a softening point of 210° C.);
0.02: p.b.w. of Rhodamin FB (C.I. 45,170); and
300: p.b.w. of ethylene glycol monomethyl ether.

Decoating in imagewise configuration was performed in an aqueous solution (pH 8) containing 3 percent of ammonium phosphate and 3 percent of an ethoxylated isotridecyl alcohol with 8 ethylene oxide units.

EXAMPLE 69

A chromed copper foil was coated with the following negative-working, light-sensitive solution:

0.25: p.b.w. of polyvinyl acetate (Hoeppler viscosity of 2,200 mPa.s in a 20 percent ethyl acetate solution at 20° C.);
0.75: p.b.w. of polyvinyl acetate (40 mPa.s);
4: p.b.w. of a phenol-formaldehyde novolak (softening range 110° to 120° C., according to DIN 53,181);
1: p.b.w. of a condensation product of cyclohexanone and formaldehyde (softening range 75° C. to 90° C.);
3: p.b.w. of 4-(2-phenylprop-2-yl)-phenyl ester of 1,2-naphthoquinone-2-diazide-4-sulfonic acid;
0.2: p.b.w. of crystal violet;
88.8: p.b.w. of ethylene glycol; and
2: p.b.w. distilled $H_2O$.

The resulting plate was electrochemically treated in an aqueous solution (pH 3) containing 3 percent of lithium sulfate and 1 percent of sodium octyl-sulfate.

EXAMPLE 70

A dry-brushed aluminum foil was provided with a liquid photo-resist layer having the following composition:

4: p.b.w. of a cresol-formaldehyde novolak (melting range 105°–120° C., according to DIN 53,181);
1: p.b.w. of bis-1,2-naphthoquinonediazide-5-sulfonic acid ester of 2-ethoxyethyl 4,4'-bishydroxyphenylvalerate; and
40: p.b.w. of methyl ethyl ketone.

After the coated foil was dried, electrochemical treatment was carried out in an aqueous solution (pH 3) containing 3 percent of lithium sulfate and 1 percent of sodium octyl-sulfate.

EXAMPLES 71 TO 102

Certain of the copying materials described above were electrochemically treated in imagewise configuration in the solution indicated in the following table. The conditions are also given in the table.

TABLE II

| Example | Type of material | aqueous electrolyte Type | aqueous electrolyte Concentr. (%) | Surfactant Type | Surfactant Concentr. (%) | pH Value | Remarks (T = Temperature) |
|---|---|---|---|---|---|---|---|
| 71 | see Example 12 | Na borate | 3 | ethoxylated isotridecyl | 3 | 3.5 | — |

TABLE II-continued

| Example | Type of material | aqueous electrolyte Type | aqueous electrolyte Concentr. (%) | Surfactant Type | Surfactant Concentr. (%) | pH Value | Remarks (T = Temperature) |
|---|---|---|---|---|---|---|---|
| | | | | alcohol with 8 ethylene oxide units | | | |
| 72 | see Example 12 | Na phosphate | 3 | ethoxylated isotridecyl alcohol with 8 ethylene oxide units | 3 | 7 | pH set with $H_3PO_4$, alternating current 40 V/50 Hz |
| 73 | see Example 12 | Li sulfate | 3 | Na octylsulfate | 1 | 3 | alternating current 40 V/50 Hz |
| 74 | see Example 12 | " | 3 | " | 1 | 3 | alternating current 0.5 Hz |
| 75 | see Example 12 | " | 3 | " | 1 | 3 | alternating current 5 Hz |
| 76 | see Example 12 | " | 3 | " | 1 | 3 | alternating current 500 Hz |
| 77 | see Example 12 | $NH_4$ phosphate | 3 | " | 1 | 7.5 | — |
| 78 | see Example 12 | Na phosphate | 3 | " | 1 | 7 | pH set with $H_3PO_4$ |
| 79 | see Example 12 | Mg sulfate | 3 | " | 1 | 6 | — |
| 80 | see Example 12 | " | 3 | " | 1 | 2.5 | pH set with $H_3PO_4$ |
| 81 | see Example 12 | Na hydrogen carbonate | 3 | ethoxylated isotrodecyl alcohol with 8 ethylene oxide units | 3 | 8 | — |
| 82 | see Example 12 | Na acetate | 3 | ethoxylated isotrodecyl alcohol with 8 ethylene oxide units | 3 | 4.5 | — |
| 83 | see Example 11 | Li sulfate | 3 | stearylammonium chloride/ethylene oxide adduct with 5 ethylene oxide units | 0.6 | 5 | — |
| 84 | see Example 12 | Na hydrogen carbonate | 3 | ethoxylated isotridecyl alcohol with 8 ethylene oxide units | 3 | 4 | — |
| 85 | Layer according to example 11, support mechanically rough ened with brushes and abradants | Na chloride carbonate | 3 | ethoxylated isotridecyl alcohol with 8 ethylene oxide units | 3 | 6 | — |
| 86 | see Example 13 | Na chloride | 3 | Na octylsulfate | 1 | 4 | slight oxide layer attack |
| 87 | see Example 12 | Na lauryl-sulfate | 6 | — | — | 4 | — |
| 88 | see Example 12 | Li sulfate | 3 | stearylammonium chloride/ethylene oxide adduct with 5 ethylene oxide units | 0.6 | 7 | — |
| 89 | see Example 12 | $NH_4$ phosphate | 3 | Na decylsulfate | 1 | 9 | — |
| 90 | see Example 12 | Na phosphate | 3 | — | — | 7 | pH set with $H_3PO_4$ |
| 91 | Layer according to Example 11, support of chromate iron | Na hydrogen carbonate | 3 | ethoxylated isotridecyl alcohol with 8 ethylene oxide units | 3 | 4 | — |
| 92 | see Example 12 | Na bromide | 3 | Na octylsulfate | 1 | 3 | — |
| 93 | see Example 12 | Na chloride | 3 | Na octylsulfate | 1 | 6 | — |
| 94 | as in Example 71, support additionally rendered hydrophilic with an aqueous solution of polyvinylphosphonic acid | Li sulfate | 3 | Na octylsulfate | 1 | 3.5 | — |
| 95 | see Example 12 | Na vanadate | 3 | Na octylsulfate | 1 | 9.5 | — |
| 96 | see Example 94 | Na thiosulfate | 3 | Na octylsulfate | 1 | 3.5 | — |
| 97 | see Example 13 | $NH_4$ phosphate | 3 | ethoxylated isotridecyl alcohol with 8 ethylene oxide units | 3 | 8 | T 45° C. |

TABLE II-continued

| Example | Type of material | aqueous electrolyte Type | aqueous electrolyte Concentr. (%) | Surfactant Type | Surfactant Concentr. (%) | pH Value | Remarks (T = Temperature) |
|---|---|---|---|---|---|---|---|
| 98 | see Example 12 | Al sulfate | 3 | Na octylsulfate | 1 | 8 | — |
| 99 | see Example 11 | Na sulfate | 3 | " | 1 | 2.5 | — |
| 100 | see Example 14 | Na phosphate | 3 | — | — | 3-4 | T 45/55° C. pH set with $H_3PO_4$ |
| 101 | see Example 12 | Na nitrate | 3 | Na octylsulfate | 1 | 3 | — |
| 102 | see Example 94 | " | 3 | Na octylsulfate | 1 | 2.5 | — |

What is claimed is:

1. A process for electrochemically forming an image comprised of image and non-image areas on a multi-layered, sheet-like material comprising at least one hydrophilic, electrically conductive layer and a nonirradiated, electrically nonconductive reproduction layer provided on said conductive layer, said process comprising the steps of:

(a) contacting at least a portion of said nonirradiated, electrically nonconductive reproduction layer with an aqueous electrolyte, solution capable of conducting an electrical current, said solution having a pH in the range from about 2.0 to 10.0 and containing at least one salt of an organic or inorganic acid in a concentration from 0.1 weight percent up to the saturation limit of said salt in said aqueous electrolyte solution; and then, (b) between an electrode and said hydrophilic conductive layer, passing electrical current in a predetermined configuration through said aqueous electrolyte solution and said reproduction layer, respectively, in an amount sufficient to dissolve selected portions of said reproduction layer which correspond to non-image areas of said image, wherein step (b) is carried out at a temperature from about 20° C. to 70° C. with direct or alternating current of a density between about 1 and 100 A/dm2.

2. A process according to claim 1, wherein said electrode is stylus-shaped.

3. A process according to claim 1, wherein said aqueous electrolyte solution comprises a surfactant in a concentration ranging from about 0.1 to 5 weight percent.

4. A process according to claim 1, wherein said reproduction layer comprises at least one radiation-sensitive compound.

5. A process according to claim 4, wherein said sheet-like material is an offset printing plate.

6. A process according to claim 4, wherein said reproduction layer comprises a photoresist layer provided on a support.

7. A process as claimed in claim 4, wherein said reproduction layer is a positive-working layer.

8. A process according to claim 1, wherein said reproduction layer comprises an inorganic or organic photoconductor.

9. A process according to claim 1, wherein step (b) comprises passing electrical current between said conductive layer and a plurality of electrodes.

10. A process according to claim 1, wherein said sheet-like material comprises a metallic support subjected to a modification treatment prior to receiving said reproduction layer, said treatment rendering said support hydrophilic.

11. A process according to claim 10, wherein said modification treatment comprises at least one selected from the group consisting of (i) contacting said support with an aqueous solution of polyvinylphosphonic acid or an alkali-metal silicate and (ii) anodically oxidizing said support in an aqueous solution of an alkali-metal silicate.

12. A process according to claim 11, wherein said support comprises aluminum or an aluminum-based alloy.

13. A process according to claim 1, wherein said sheet-like material is comprised of at least one substance selected from the group consisting of zinc, chromium, magnesium, copper, brass, steel, silicon and aluminum.

14. A process according to claim 1, said process consisting essentially of said steps (a) and (b).

* * * * *